United States Patent [19]

Webb et al.

[11] Patent Number: 4,780,999

[45] Date of Patent: Nov. 1, 1988

[54] ROOF EDGE CONSTRUCTION WITH SNAP-ON ROOF BLOCK RESTRAINT

[75] Inventors: Russell Webb, Woodfin; John B. Hickman, Biltmore Forest, both of N.C.

[73] Assignee: W. P. Hickman Co., Inc., Asheville, N.C.

[21] Appl. No.: 34,546

[22] Filed: Apr. 6, 1987

Related U.S. Application Data

[63] Continuation-in-part of Ser. No. 830,463, Feb. 18, 1986, Pat. No. 4,662,129.

[51] Int. Cl.[4] ..... E04D 13/15

[52] U.S. Cl. ..... 52/96; 52/60

[58] Field of Search ..... 52/96, 60, 94, 97, 58

[56] References Cited

U.S. PATENT DOCUMENTS

| | | |
|---|---|---|
| Re. 26,056 | 7/1966 | Hickman . |
| 1,337,840 | 4/1920 | Hawley . |
| 1,740,753 | 12/1929 | Vallas . |
| 1,782,246 | 11/1930 | Schneider . |
| 2,219,992 | 10/1940 | Hanson . |
| 2,250,548 | 7/1941 | Ness . |
| 2,857,861 | 10/1958 | Trostle . |
| 3,012,376 | 12/1961 | Reddy et al. . |
| 3,024,573 | 3/1962 | McKinley . |
| 3,090,161 | 5/1963 | Edwards . |

(List continued on next page.)

FOREIGN PATENT DOCUMENTS

| | | |
|---|---|---|
| 603078 | 8/1960 | Canada . |
| 1509147 | 11/1969 | Fed. Rep. of Germany . |
| 1933004 | 1/1971 | Fed. Rep. of Germany . |
| 2060292 | 6/1972 | Fed. Rep. of Germany . |
| 2316266 | 10/1974 | Fed. Rep. of Germany . |
| 2335223 | 1/1975 | Fed. Rep. of Germany . |
| 1024071 | 3/1966 | United Kingdom . |
| 1104027 | 2/1968 | United Kingdom . |
| 1347974 | 2/1974 | United Kingdom . |
| 2084628 | 4/1982 | United Kingdom . |

OTHER PUBLICATIONS

"Drip-Proof Fascia and Cant Dam Systems F-Series "-MM Systems Corp. (1 sheet).

"Our Complete Product Line includes . . . " Hickman Aluminum Construction Products, 1982-16 pages.

"Purpose-made accessories for Braas Flat Roofs 1004 NA" -Technique+Detail Braas (10 pages).

PVC Flat-Roof Systems-Braas (9 pages).

Hilite Fascia "A"-Pomar Building Products, Inc. (1 sheet).

"Master-Edge Extruded Aluminum Fascia: The Ultimate In Perimeter Roof Construction-1 sheet.

Type JJ-Alcoa (1 sheet).

*Primary Examiner*—Carl D. Friedman

*Assistant Examiner*—Michael Safavi

*Attorney, Agent, or Firm*—Harness, Dickey & Pierce

[57] ABSTRACT

An assembly is disclosed for forming a raised roof edge on a building structure that preferably has a generally horizontal roof and a geneally vertical outer face. The assembly includes a dam member for forming a water dam or gravel stop and a fascia member. Preferably, the dam member is a one-piece structure, including a clamping and retention portion and a vertical intermediate portion, and biases and secures the fascia member into a relatively tight and rattle-free interlocking installation on the dam member. Preferably, a roofing material is gripped and held against the dam member as a result of the biasing forces of the clamping and retention portion and the intermediate dam portion. The roof edge assembly thereby provides an improved water dam or gravel stop structure that securely retains the roofing material on the roof of the building structure without penetrating the roofing material, at least along the roof surface. Also, because the roof edge assembly is adapted for installation on roof structures employing roofing pavers or other such roof-covering devices, and preferably anchors and retains the roofing pavers, the roof edge assembly of the present invention features increased stability and resistance to uplift forces in comparison to more conventional roof edge assemblies.

8 Claims, 2 Drawing Sheets

U.S. PATENT DOCUMENTS 3,237,352 3/1966 Edwards .
3,405,485 10/1968 Edwards .
3,447,273 6/1969 Thom .
3,488,902 1/1970 Gobel .
3,503,162 3/1970 Ward .
3,533,201 10/1970 Tyler .
3,571,992 3/1971 Comiskey .
3,608,255 9/1971 Chomes .
3,624,973 12/1971 Attaway .
3,719,010 3/1973 Hickman .
3,731,439 5/1973 Hickman .
3,735,540 5/1973 Thaler .
3,802,140 4/1974 Hickman .
4,037,372 7/1977 Patry .
4,071,987 2/1978 Hickman .
4,241,549 12/1980 Hall, III et al. .
4,419,850 12/1983 Butzen .
4,472,913 9/1984 Hickman ..... 52/96
4,488,384 12/1984 Hickman .
4,549,376 10/1985 Hickman .
4,586,301 5/1986 Hickman .
4,662,129 5/1987 Hickman ..... 52/96

ROOF EDGE CONSTRUCTION WITH SNAP-ON ROOF BLOCK RESTRAINT

BACKGROUND AND SUMMARY OF THE INVENTION

This is a continuation-in-part of a copending application for U.S. Letters Patent, Ser. No. 830,463, now U.S. Pat. No. 4,662,129 filed Feb. 18, 1986, and entitled ROOF EDGE CONSTRUCTION WITH COMPRESSION AND FLASHING MEMBERS, the disclosure of which is hereby incorporated by reference.

The invention relates generally to building structures and more particularly to raised roof edge constructions for such building structures.

Various raised roof edge assemblies, gravel stop assemblies, water dams, and the like, have been provided for purposes of anchoring sheet-like roofing membrances, retaining gravel ballast or other roofing materials controlling water drainage, and for supporting fascia members at the edge of the roof of a building structure. Examples of such previously-provided assemblies are disclosed in U.S. Pat. Nos. 3,719,010; Re. 26,056; 4,071,987; 4,472,913; 4,488,384; 4,549,376; 4,586,301; 4,598,507; 4,617,770; and 4,641,476 the references cited therein, and in the above-referenced copending U.S. application, as well as in another copending U.S. application owned by the same assignee as the present invention: Ser. No. 011,921, filed Feb. 6, 1987, entitled ROOF EDGE CONSTRUCTION. The disclosures of these patents and these applications are hereby incorporated herein by reference.

The roof edge assemblies disclosed in the above-referenced patents and applications represent great strides over previous roof edge constructions in terms of stability, simplicity, cost-effectiveness, ease of installation, and effectiveness in anchoring roofing membranes. It has been found, however, in many instances that it is desirable to even further increase the anchoring engagement of a roofing material at the edge of a building structure without penetrating through the roofing material, at least on the roof side of the structure, and to even further increase the resistance of the roof edge assembly to wind or other uplift loads. It has also been found that the use of preformed roof-covering members, frequently referred to as "roofing pavers", has become highly desirable, and thus the use of such roofing pavers has dramatically increased.

Therefore, the present invention seeks to provide such further increased stability, and such increased anchoring and holding power of a roofing material without such penetrations on the roof side, in a fascia mounting and supporting assembly that forms a raised roof edge or gravel stop at the outer edge of the roof structure and that is applicable in roofing systems employing roof-covering elements known as roofing pavers or roof paving blocks, or other such roof-covering members. The invention further addresses itself to increasing both the simplicity of the components involved in the assembly and the ease of their installation.

According to the present invention, an assembly is provided for forming a raised roof edge on a building structure of the type that typically has a generally vertical outer face and a generally horizontal roof surface with one or more roof-covering members thereon. The assembly according to the present invention includes a dam and retainer member, preferably with a vertical dam portion having an inwardly directed face for generally confronting the outer face of the building structure, and that is anchorable to the building structure generally adjacent an edge portion of the roof surface. A fascia member is installable on the dam member and preferably includes a generally concave upper portion for receiving the upper dam portion therein, as well as a lower fascia portion for receiving a lower edge portion of the dam member therein, when the facia member is installed on the dam member.

Preferably the dam and retainer member includes a clamping or retention portion that generally overlaps a portion of the roof paving block or other such roof-covering member so as to bias the roof paving block against the roof. Preferably, a sheet-like roofing material is included on the horizontal roof surface, either above or below the roof-covering member or members, with the roofing material being anchored between the clamping or retention portion and the dam and retainer member. Also a portion of the dam and retainer member preferably includes a generally vertical intermediate portion that serves as an end stop for the roof-covering member or members.

Additional objects, advantages, and features of the present invention will become apparent from the following description and appended claims, taken in conjunction with the accompanying drawings.

DETAILED DESCRIPTION OF THE PREFERRED EMBODIMENTS

Figure 1:
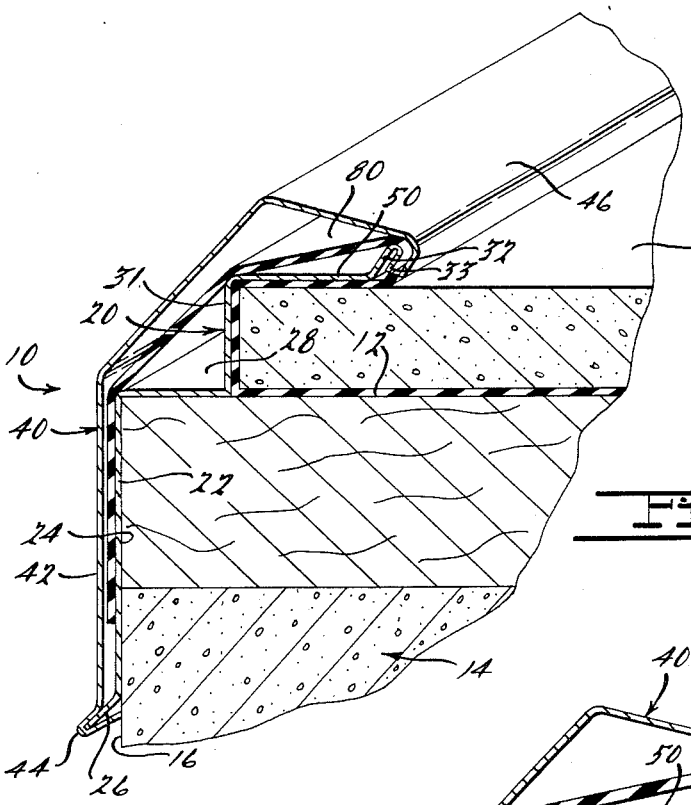
FIG. 1 is a perspective view of an exemplary raised roof edge assembly secured to the top edge of a building in accordance with the present invention.

FIGS. 1 through 4 illustrate various exemplary embodiments of an assembly for forming a raised roof edge on a building structure in accordance with the present invention. It should be noted, however, that the present invention is applicable in roof edge assemblies for building structure other than that shown for purposes of illustration in the drawings, as well as in other applications for forming building edge constructions.

Figure 2:
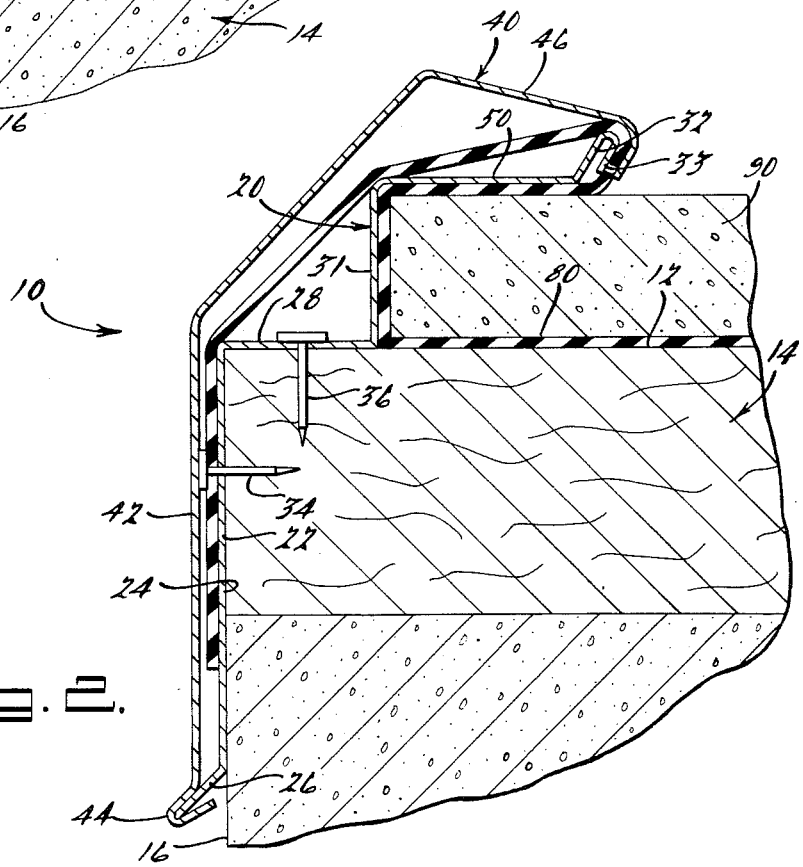
FIG. 2 is a cross-sectional view of the roof edge assembly of FIG. 1.

In FIGS. 1 and 2, a preferred raised roof edge assembly 10 for forming a raised roof edge and water dam on a horizontal roof surface 12 of a building structure 14 generally includes a dam and retainer member 20, a fascia member 40, with a clamping and retention portion 50 of the dam and retainer member 20 for securing the fascia member 40 to the dam and retainer member 20 and to the building structure 14. Preferably, and perhaps more commonly in practice, the assembly 10 also includes a portion of a preferably flexible and resilient roofing material 80 overlappingly engaging the dam and retainer member 20 and being grippingly interposed between clamping and retention portion 50 and one or a number of roofing pavers or other roof-covering members 90 on the horizontal roof surface 12. Such roofing pavers are typically in the form of preformed concrete roof paving blocks or panels, or other preformed or precast generally flat roof-covering members, although other forms of roof-covering members can be employed.

The preferred dam and retainer member 20 includes a generally vertical dam portion 22 having an inwardly directed face 24 positionable in a generally confronting relationship with an outer face 16 of the building structure 14. The vertical dam portion 22 extends generally upwardly from a lower dam edge portion 26 to a preferably generally transverse dam portion 28 disposed above the roof surface 12 of the building structure 14 when the vertical dam portion 22 is positioned thereon. The dam and retainer member 20 preferably also includes a generally vertical intermediate dam portion 31, which serves as an end stop for the roofing pavers 90. A generally upwardly-protruding, and preferably inwardly-sloping, flange portion 32, is provided at the upper and inward edge of the clamping and retention portion 50 for attaching the fascia 40 to the roof 12, as described below. One or more fasteners 34 and 36 are preferably, but optionally, provided for attaching or anchoring the vertical dam portion 22 to the outer face 16 of the building structure 14, and for attaching and anchoring the upper dam portion 28 to the roof surface 12, respectively. The lower dam edge portion 26 can advantageously be bent or otherwise formed in a generally downwardly and outwardly extending direction (as shown in the drawings).

The preferred fascia member 40 is formed of a sheet material, such as sheet metal, extruded metal, or plastic, for example, and preferably includes a generally vertical fascia portion 42 extending between a lower channel portion 44 and a generally concave upper portion 46. As is illustrated in FIGS. 1 and 2, the concave upper portion 46 interlockingly receives and overlappingly engages and resiliently deflects the flange portion 32 adjacent the clamping and retention portion 50, and the lower channel portion 44 similarly interlockingly receives the lower dam edge portion 26. As with the lower dam edge portion 26, the flange portion 32 is advantageously bent or otherwise formed with a generally downwardly-extending end portion 33 in order to form a smooth, stress-minimizing bend for engaging the roofing material 80 as it is clamped between the flange portion 32 and the fascia 40.

Besides securing the fascia 40 to the roof 12, and clampingly retaining the sheet material 80, the dam and retainer member 20 also anchors and retains the roofing pavers 90. This is done by way of the engagement of the clamping and retention portion 50 acting in a generally downward direction on the roofing pavers 90, as well as by way of the engagement of the vertical intermediate dam portion 31, which serves as a stop for horizontally retaining the roof pavers 90. Thus the fascia member 40 is securingly snapped onto the dam member 20, and interlockingly retained on the building structure 14, and the roofing paver 90 is horizontally retained and urged against the roof surface 12, all of such functions being performed by a preferably one-piece dam and retention member 20, which can be formed from a resilient sheet-like spring material, such as aluminum or spring steel, for example.

The roofing material 80 is preferably a flexible sheet-like material, which may be a resilient plastic, a resilient rubber or other elastomeric material, a tar paper, a roofing felt, or other suitable roofing materials known to those skilled in the art. The roofing material 80 is preferably flatly retained and anchored on the roof surface 12 by the roofing pavers 90. A portion of the roofing material 80 is interposed and gripped between at least the clamping and retention portion 50 and both the fascia member 40 and the roofing paver 90. The roofing material 80 also extends between vertical intermediate dam portion 31 to be grippingly engaged and clamped against the roofing paver 90, as well as preferably overlapping the vertical dam portion 22 to be grippingly engaged between the vertical dam portion 22 and the fascia member 40. Although such an arrangement is preferred, it may be found to be sufficient in some applications if the roofing material extends only far enough to be engaged and grippingly secured between the clamping and retention member 50 and the fascia 40.

Because the roofing material 80 is grippingly clamped and anchored between the various components discussed above, and flatly anchored to the roof surface 12 by the roofing pavers 90, it is very positively and securely retained on the building structure and protected from wind or other forces. By such an arrangement, tears, fatigue failures or punctures that could cause leaks in the roofing material 80 are substantially avoided, thereby adding to the durability and life of the overall roof structure. Furthermore, because of the above-described anchoring engagement of the roofing pavers 90 with the dam member 20, the stability and resistance to uplift of the entire roof edge assembly 10 is greatly enhanced over that of more conventional roof edge structures. Furthermore, by anchoring the roofing material 80 and the roof pavers 90 along the roof edge, the exposure of these components to forces exerted on them by the wind or wind-blown materials is substantially limited to their upper surfaces, thereby tending to hold them tight against the roof surface 12.

In the past, many various attempts at such edge anchoring have been made, including the bolting of plates to the roof edge, for example, but have proved to be costly, unsightly, and cumbersome, as well as being inconvenient or unusable because of interference with roof edge dams or other such assemblies. The present invention seeks to accomplish this edge-anchoring function in a manner that is integrated with the roof edge assembly. The clamping and retention means in the roof edge assembly according to the present invention performs this function, as well as securing a fascia member to a building structure.

Figure 3:
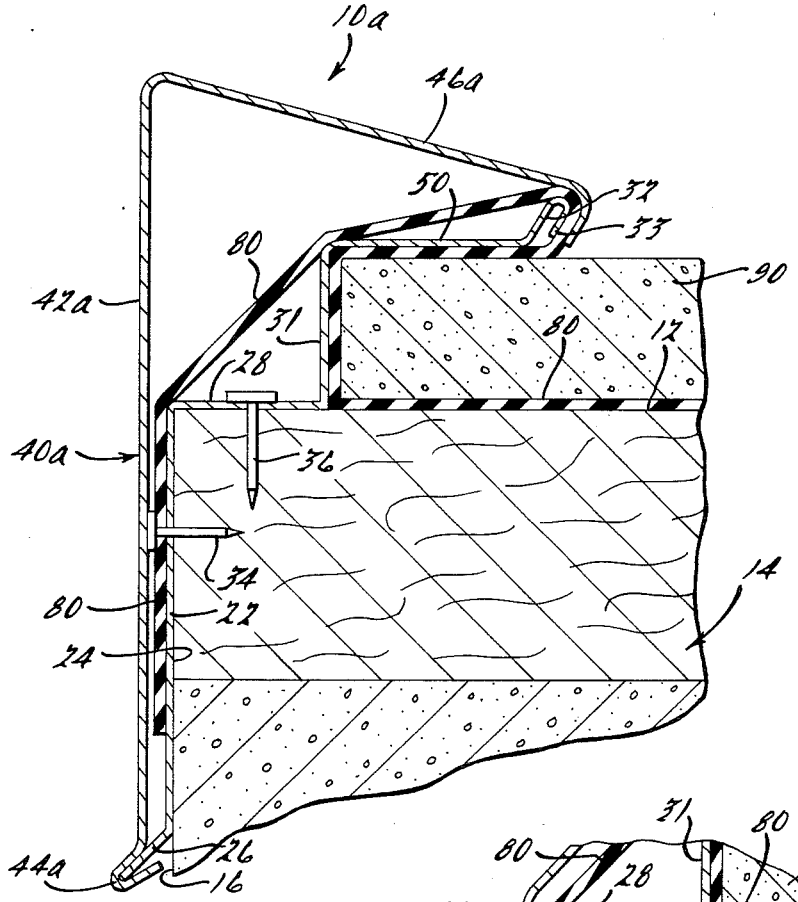
FIG. 3 is a cross-sectional view, similar to that of Figure 2, but illustrating another embodiment of the roof edge assembly according to the present invention.

FIG. 3 illustrates an alternate embodiment of the invention, wherein a raised roof edge assembly **10*a* is generally similar to the raised roof edge assembly 10 shown in FIGS. 1 and 2, with the exception of the provision of a fascia 40*a*, which has an extended vertical fascia portion 42*a* that extends upwardly to a greater extent than the vertical fascia portion 42 of FIGS. 1 and 2. Since the remaining components of the alternate raised roof edge assembly 10*a* are substantially similar to the corresponding components of the raised roof edge assembly 10, the same reference numerals are used to indicate such similar corresponding components. It should also be noted that the various optional variations pointed out above in connection with the embodiment of FIGS. 1 and 2** are generally also applicable in the other embodiments of the invention.

Figure 4:
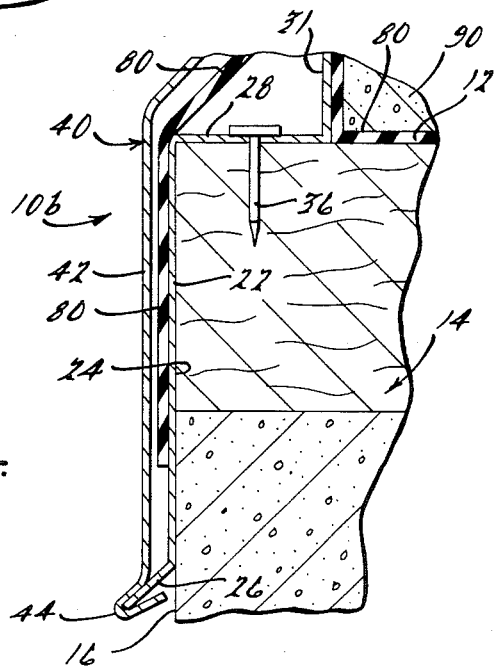
FIG. 4 is still another cross-sectional view, similar to that of FIG. 2, but illustrating still another embodiment of the roof edge assembly according to the present invention.

In FIG. 4, another alternate and optional embodiment of the invention is illustrated, wherein the roof edge assembly **10*b* is generally similar to the roof edge assembly 10 of FIGS. 1 and 2 and the roof edge assembly 10*a* of FIG. 3, except for the elimination of the optional fastener 34 anchoring the vertical dam portion 22 to the outer face 16 of the building structure 14, thus eliminating the need for a penetration through the roofing material 80 even along the vertical outer face 16. In other respects, however, the roof edge assembly 10*b* is substantially similar to the corresponding components of FIGS. 1 through 3, and thus such corresponding components are similarly numbered. It should be noted in this regard that the alternate arrangement shown in FIG. 4 can also optionally be employed with any of the embodiments of the invention, if such outer face anchoring of the roofing material 80** is not deemed necessary.

The foregoing discussion discloses and describes exemplary embodiments of the present invention. One skilled in the art will readily recognize from such discussion, and from the accompanying drawings and claims, that various changes, modifications, and variations may be made therein without departing from the spirit and scope of the invention as defined in the following claims.

What is claimed is:

1. An assembly for forming a raised roof edge on a building structure having a generally horizontal roof surface and a plurality of roof paving blocks on the horizontal roof surface, said assembly comprising:

a dam member, and anchoring means for anchoring said dam member to the building structure generally adjacent an edge of the horizontal roof surface;

a fascia member installable on said dam member; and said dam member further including a generally vertical lower dam portion, a generally vertical intermediate dam portion extending in a generally upward direction, a generally transverse dam portion interconnecting said generally vertical lower dam portion and said vertical intermediate dam portion, and a flange portion interlockingly engageable with the fascia member when said fascia member is installed on the building structure, said vertical intermediate dam portion engaging the roof paving blocks and forming a stop for horizontally retaining the roof paving blocks, said dam member further including clamping means and retention means as a one-piece member with said dam member for securing said fascia member relative to said dam member when said fascia member is installed on said dam member, said clamping and retention means urging said fascia member generally against said dam member, said clamping and retention means further overlapping and biasing the roof paving blocks against the horizontal roofing surface at least in an area generally adjacent the edge of the horizontal roof surface.

2. An assembly according to claim 1, wherein the building structure includes a sheet-like roofing material disposed thereon in an overlying relationship with the horizontal roof surface and at least a portion of said dam member, said roofing material being anchored between said clamping and retention means of said dam member and at least said roof paving blocks when said assembly is installed on the building structure.

3. An assembly according to claim 2, wherein said sheet-like roofing material is in part disposed between the roof paving blocks and the horizontal roof surface.

4. An assembly according to claim 3, wherein said sheet-like roofing material is in part anchored between said fascia member and said dam member.

5. An assembly for forming a raised roof edge on a building structure having a generally vertical outer face, a generally horizontal roof surface, and a plurality of roof paving blocks on the horizontal roof surface, said assembly comprising:

a dam member including a generally vertical lower dam portion and a transverse dam portion extending in a generally transverse direction relative to said vertical lower dam portion, said dam member further including a generally vertical intermediate portion, a clamping and retention portion having an upper flange portion thereon, and a lower dam edge portion on said vertical lower dam portion, said vertical intermediate dam portion and said clamping and retention portion extending upwardly above the horizontal roof surface of the building structure, and anchoring means for anchoring said transverse dam portion to the horizontal roof surface generally adjacent an edge of the horizontal roof surface;

a fascia member installable on said dam member, said fascia member including a generally concave upper fascia portion and a generally concave lower fascia portion, said fascia member being configured for receiving said lower dam edge portion in said lower fascia portion, and said upper fascia portion being configured for receiving said upper flange portion when said fascia member is installed on said dam member;

said clamping and retention portion securing said fascia member to said building structure and overlapping and biasing the roof paving blocks against the horizontal roofing surface at least in an area generally adjacent the edge of the horizontal roof surface; and the building structure including a sheet-like roofing material disposed thereon in an overlying relationship with the horizontal roof surface and at least a portion of said dam member, said roofing material being anchored between at least said clamping and retention member of said dam member and at least said roof paving blocks when said assembly is installed on the building structure.

6. An assembly according to claim 5, wherein said sheet-like roofing material is in part disposed between the roof paving blocks and the horizontal roof surface.

7. An assembly according to claim 6, wherein said sheet-like roofing material is in part anchored between said fascia member and said dam member.

8. An assembly according to claim 5, wherein the roofing material is clampingly anchored between said generally vertical intermediate dam portion and the roof paving blocks.

* * * * *

UNITED STATES PATENT AND TRADEMARK OFFICE

CERTIFICATE OF CORRECTION

PATENT NO. : 4,780,999

DATED : November 1, 1988

INVENTOR(S) : Russell Webb et al

It is certified that error appears in the above-identified patent and that said Letters Patent is hereby corrected as shown below:

| | | |
|---|---|---|
| Page 1, | line 3, | Abstract: "geneally" should be --generally--. |
| Column 1, | line 18-19, | "membrances" should be --membranes--. |
| Column 2, | line 8, | "facia" should be --fascia--. |

Signed and Sealed this

Twenty-first Day of November, 1989

*Attest:*

JEFFREY M. SAMUELS

*Attesting Officer*

*Acting Commissioner of Patents and Trademarks*